US006350225B1

(12) United States Patent
Sheeran et al.

(10) Patent No.: US 6,350,225 B1
(45) Date of Patent: Feb. 26, 2002

(54) SUPPORT BRIDGE FOR PREVENTING CENTRIFUGAL FORCES FROM COLLAPSING A CONTAINER PLACED IN A CENTRIFUGE ROTOR

(75) Inventors: Edward Thomas Sheeran; William Andrew Romanauskas, both of Southbury, CT (US)

(73) Assignee: Kendro Laboratory Products, L.P., Newton, CT (US)

( * ) Notice: Subject to any disclaimer, the term of this patent is extended or adjusted under 35 U.S.C. 154(b) by 0 days.

(21) Appl. No.: 09/606,983

(22) Filed: Jun. 29, 2000

Related U.S. Application Data

(60) Provisional application No. 60/141,995, filed on Jul. 1, 1999.

(51) Int. Cl.[7] ..... B04B 5/02; B04B 7/06

(52) U.S. Cl. ..... 494/12; 494/20; 494/21; 215/386; 220/646

(58) Field of Search ..... 494/12, 16, 20, 494/21, 85; 422/72, 102; 220/640, 646, 724; 215/12.1, 42, 386, 390, 393, 395, 396

(56) References Cited

U.S. PATENT DOCUMENTS

| | | | | | |
|---|---|---|---|---|---|
| 2,250,666 | A | * | 7/1941 | Godefroy | |
| 2,447,330 | A | * | 8/1948 | Grebmeier | 494/16 |
| 2,878,994 | A | * | 3/1959 | Anderson | |
| 3,071,316 | A | * | 1/1963 | Piemonte et al. | |
| 3,133,882 | A | * | 5/1964 | Mitchell et al. | |
| 3,265,296 | A | * | 8/1966 | Mitchell | |
| 4,439,177 | A | * | 3/1984 | Conway | 494/20 |
| 4,537,320 | A | * | 8/1985 | Nielsen | |
| 5,395,001 | A | * | 3/1995 | Moore | 494/16 |
| 5,558,616 | A | * | 9/1996 | Barkus et al. | 494/12 |
| 5,591,114 | A | | 1/1997 | Romanauskas | 494/20 |
| 5,624,370 | A | | 4/1997 | Romanauskas | 494/20 |
| 5,692,630 | A | * | 12/1997 | Hsu | 215/386 |
| 5,816,998 | A | * | 10/1998 | Silverstolpe et al. | 494/20 |

* cited by examiner

*Primary Examiner*—Charles E. Cooley
(74) *Attorney, Agent, or Firm*—Ohlandt, Greeley, Ruggiero & Perle, L.L.P.

(57) ABSTRACT

A container assembly having a support bridge to prevent centrifugal forces from collapsing the container. A lid is positioned on top of the container, and the support bridge is disposed between the lid and an upper portion of the container.

24 Claims, 6 Drawing Sheets

SUPPORT BRIDGE FOR PREVENTING CENTRIFUGAL FORCES FROM COLLAPSING A CONTAINER PLACED IN A CENTRIFUGE ROTOR

CROSS-REFERENCES TO RELATED APPLICATIONS

The present application is claiming priority of provisional application Serial No. 60/141,995, filed on Jul. 1, 1999.

BACKGROUND OF THE INVENTION

1. Field of the Invention

The present invention relates to a container assembly having a support bridge that is capable of preventing collapse of the container during centrifugation. A lid is positioned on top of the container, and the support bridge is disposed between the lid and an upper portion of the container.

2. Description of the Prior Art

A centrifuge instrument is a device by which liquid samples may be subjected to a centrifugal force. Swinging bucket centrifuge systems are well known in the centrifuge art. The rotor in such a system is adapted to receive a bucket that hangs from the rotor body. When the rotor is at rest, the bucket hangs in a generally vertical position. When the rotor is accelerated, the bucket swings from its rest position to a horizontal position.

U.S. Pat. No. 5,591,114 to Romanauskas, which is incorporated herein by reference, discloses a swinging bucket centrifuge rotor. The body of the rotor has at least one pair of confronting planar sidewalls that are circumferentially spaced apart to define a generally axially extending slot. Each planar sidewall has a trunnion pin mounted thereon, and the trunnion pins as a pair serve to receive a swinging bucket.

U.S. Pat. No. 5,624,370 to Romanauskas, which is incorporated herein by reference, discloses a bucket for use in a swinging bucket centrifuge rotor. The bucket has a cylindrical body with a pair of planar abutments formed on the body. The abutments are diametrically disposed on the body. A slot is formed between each abutment and a portion of the body of the bucket, and each slot has a groove. The bucket is installed on a rotor by lowering the bucket onto a pair of rotor trunnion pins such that each trunnion pin is received within a groove defined on a respective abutment.

A container for use in a swinging bucket centrifuge system and made of a rigid material is generally cylindrical in form. However, a swinging bucket can also define a generally rectangular volume within which a flexible or non-cylindrical container can be held. Such an arrangement is commonly used for holding blood bags for centrifugation of blood.

The centrifugal force that advantageously serves to separate a liquid sample into its constituent parts also acts upon the container that holds the sample. The container must be capable of withstanding this force otherwise it will be disfigured or destroyed. For example, if a blood bag is not substantially full during centrifugation, the unfilled portion of the bag will crease and fold into the remainder of the bag and blood particles can become lodged in a crease. Even in the case of a more rigid container, the structural integrity of the container must be sufficient to ensure that it does not collapse under the stress of centrifugal force.

In the prior art, the integrity of a container held within a swinging bucket is maintained by either substantially filling the container or by reinforcing the walls of the container. Filling a container is a problem in the case where an operator wishes to work with a sample volume that is less than the amount required to fill the container. On the other hand, reinforcing the walls of a container requires the use of a material that is thicker or stronger than the material used for a non-reinforced container. Consequently, a container with reinforced walls is heavier, less transparent, has a reduced volume capacity and is more expensive than a non-reinforced container. Furthermore, such a container cannot be made by an inexpensive manufacturing process such as blow molding.

There is a need for a lightweight, inexpensive container assembly that does not collapse when subjected to centrifugal force.

There is also a need for such a container assembly that accommodates a flexible or non-cylindrical container.

SUMMARY OF THE INVENTION

A container assembly comprising a container housing, a lid for sealing the container housing, and a support bridge positioned below the lid and about the neck of the container housing, thereby preventing centrifugal forces acting on the lid, and on the neck and shoulder of the container, from collapsing the container during centrifugation. To secure its position, the support bridge, in one embodiment of the invention, has an aperture for securing the lid and a counter bore defining a flange that engages an edge of the lid. A lip formed at either end of the bridge engages a respective edge of a swinging bucket in which the container is disposed during centrifugation.

It will be noted, as the description of one embodiment herein proceeds, that the container includes a chamber that can have a non-cylindrical form. In an alternate embodiment, the chamber can be a bag.

It will especially be appreciated by those skilled in the art that the present invention permits the use of a container made of an inexpensive, lightweight material.

DETAILED DESCRIPTION OF THE INVENTION

Figure 1:
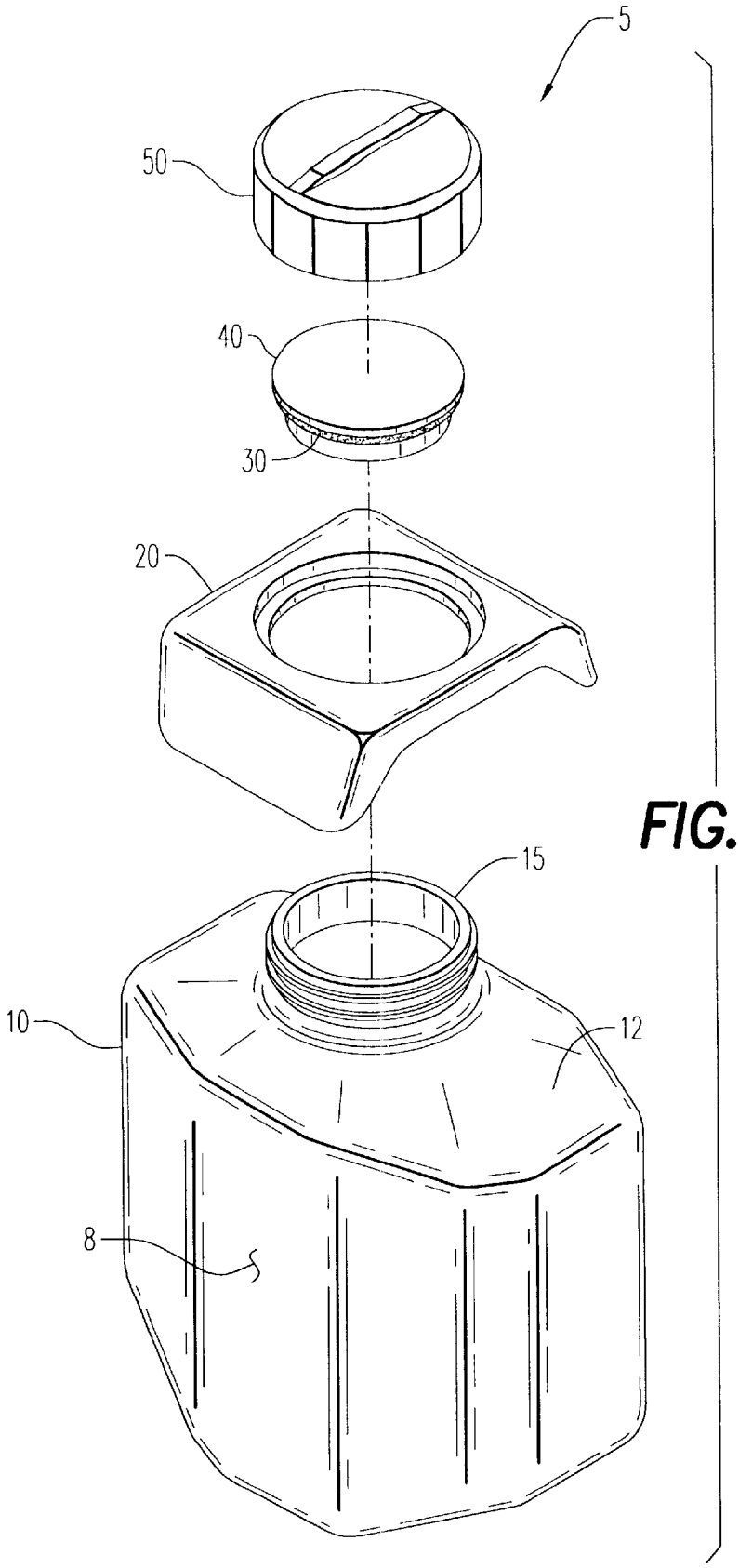
FIG. 1 is an exploded top perspective view showing components of a container assembly for use in a centrifuge system in accordance with the present invention.

The present invention can best be described by reference to the attached figures, wherein FIG. 1 is an exploded view of a container assembly 5 for use in a centrifuge system in accordance with the present invention. The assembly includes a container 10, a support bridge 20, and a lid 50. Optionally, an o-ring 30 and an insert plug 40 can be included.

Container 10 has a chamber 8, a shoulder 12, and a neck 15 with a threaded surface and an opening through which chamber 8 is accessed. Lid 50 has a threaded surface that engages the threads of neck 15. For an enhanced seal, o-ring 30 is positioned on the circumference of insert plug 40, which is inserted into the opening of container 10.

Lid 50, with the assistance of insert plug 40 and o-ring 30, seals container 10. Neck 15 could have a threaded interior surface and lid 50 could have a threaded exterior surface, or vice versa. However, the threaded surfaces are not essential, and lid 50 can seal container 10 in any suitable manner.

As explained below, support bridge 20 prevents lid 50, insert plug 40 and o-ring 30, and also neck 15 and shoulder 12, from collapsing container 10 when they are subjected to centrifugal forces. It can be made of any material capable of withstanding the centrifugal forces. In a preferred embodiment, support bridge 20 is a collar, made of polypropylene, disposed about neck 15.

Figure 2A:
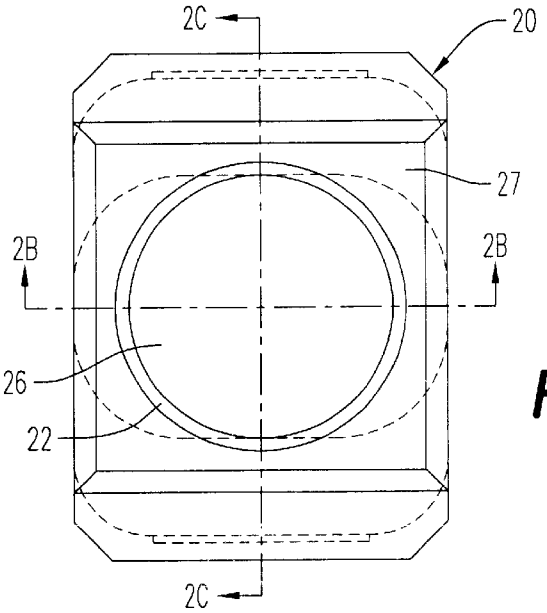
FIG. 2A is a top plan view of a support bridge in accordance with the present invention.
Figure 2B:
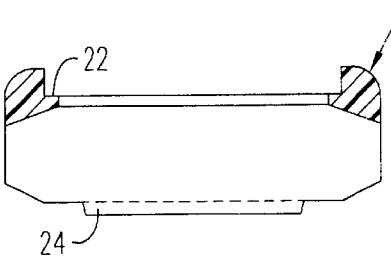
FIG. 2B is a front elevational view with a vertical section taken along line 2B—2B of FIG. 2A.
Figure 2C:
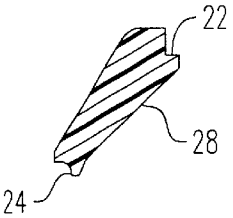
FIG. 2C is a vertical section taken along line 2C—2C of FIG. 2A.
Figure 2C:
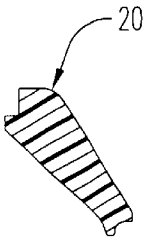

FIGS. 2A through 2C are, respectively, a top planar view, a front sectional view and a side sectional view of the support bridge 20 shown in FIG. 1. Support bridge 20 is substantially reverse U-shaped. It has a substantially horizontal portion 27 with an aperture 26 that receives the container lid 50 (FIG. 1) and a counter bore defining a lip or flange 22 that engages an edge of lid 50. A vertically sloping portion 28 substantially conforms to the contour of the container shoulder 12 (FIG. 1). Lip 24 engages an edge of a structure within which container 10 (FIG. 1) is held.

Because it prevents the collapse of container 10, support bridge 20 allows for container 10 to be made of an inexpensive, lightweight material. For example, container 10 can be manufactured of any plastic including polyethyleneterephthalate, polypropylene, or polycarbonate, and its walls can be as thin as 1 millimeter. However, in a case where plastic is inappropriate, container 10 can be manufactured of any conventional material, including a metal such as stainless steel. Support bridge 20 also allows for container 10 to be manufactured by an inexpensive process such as blow molding.

Another advantage of support bridge 20 is that it permits chamber 8 to have either a cylindrical or non-cylindrical form. In a preferred embodiment, chamber 8 has a non-cylindrical form that permits a greater volume of material to be centrifuged as shown in the discussion accompanying FIG. 5.

Figure 3A:
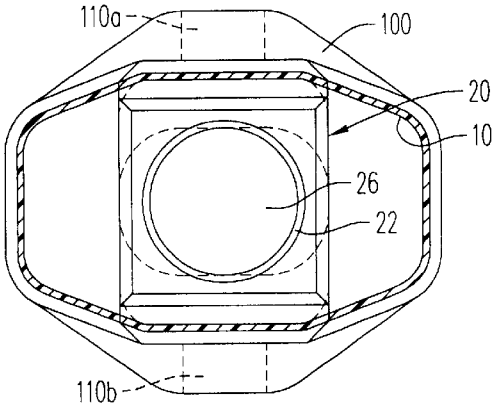
FIG. 3A is a top plan view of the container assembly of FIG. 1 shown mounted in a swinging bucket.
Figure 3C:
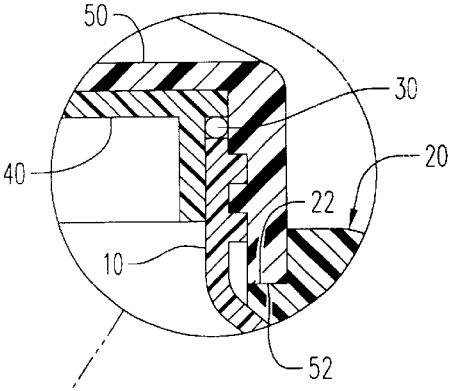
FIG. 3C is a vertical sectional view taken along line 3C—3C of FIG. 3B.
Figure 3C:
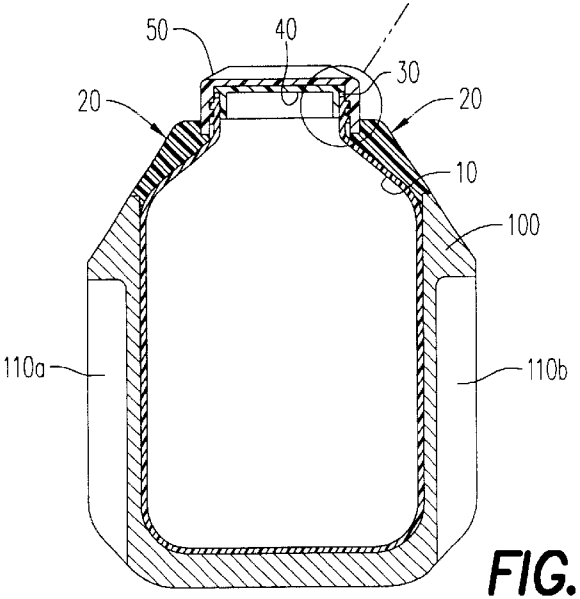
Figure 3B:
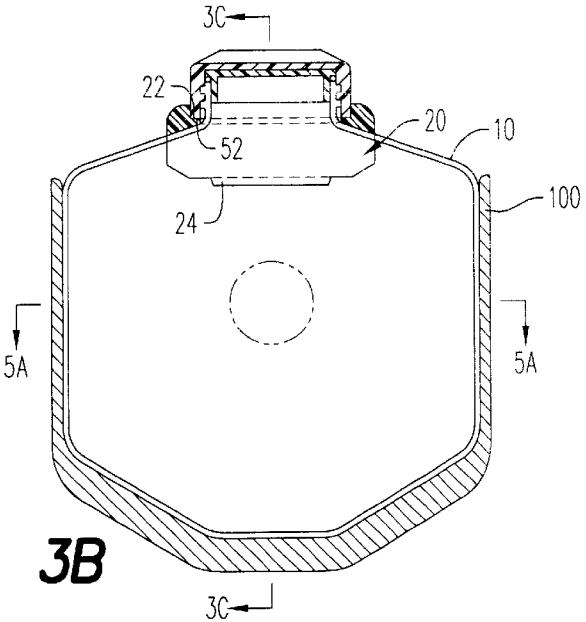
FIG. 3B is a front elevational view with portions in vertical section, of the assembled container assembly of FIG. 1 shown mounted in a swinging bucket shown in vertical section.

FIGS. 3A through 3C are, respectively, a top planar view, a front sectional view and a side sectional view of the container assembly shown in FIG. 1 held in a swinging bucket 100 for use in a swinging bucket centrifuge system. As a term of art, a non-cylindrical bucket such as swinging bucket 100 is sometimes referred to as a "rectangular bucket", although its footprint is not truly a quadrilateral.

Figure 4:
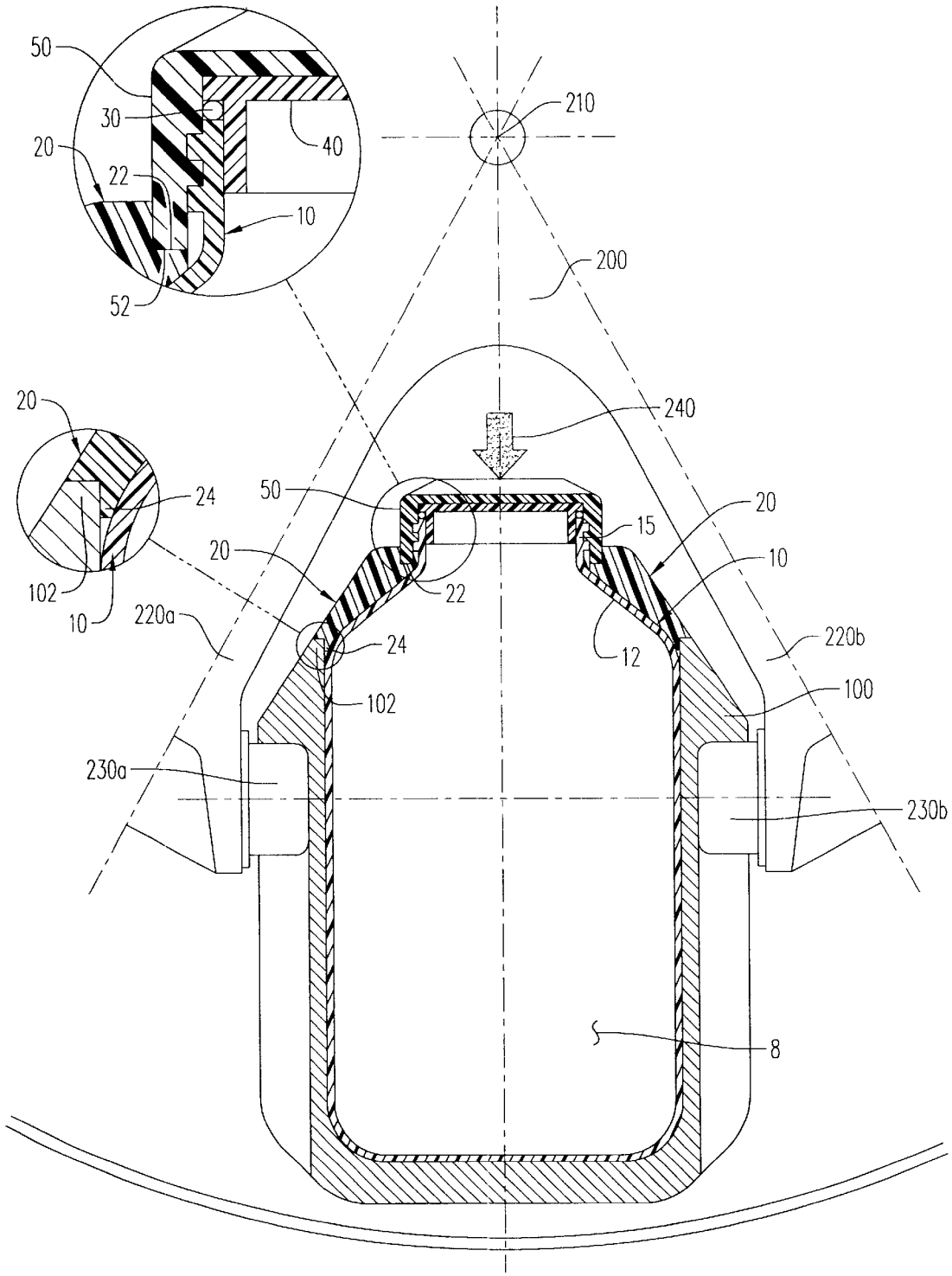
FIG. 4 is a horizontal sectional view as would be seen along line 3C—3C of FIG. 3B showing the assembled container assembly of FIG. 1 during a centrifuge operation.

Swinging bucket 100 includes slots 110*a* and 110*b* that slide over trunnion pins (FIG. 4, reference 230*a* and 230*b*) for mounting on a swinging centrifuge rotor (FIG. 4, reference 300). Swinging bucket 100 can be a solid unit, a basket or merely a frame. In this application it serves as a holder for container 10.

FIG. 4 is a horizontal sectional view as would be seen along line 3C—3C of FIG. 3B showing the assembled container assembly of FIG. 1 during a centrifuge operation. A rotor 200 is adapted for rotational motion within a centrifuge instrument about a vertical axis of rotation 210. Rotor 200 includes a pair of radially extending arms 220*a* and 220*b* with corresponding trunnion pins 230*a* and 230*b* to accommodate swinging bucket 100.

In operation, swinging bucket 100 swings into a horizontal position generally perpendicular to the vertical axis of rotation 210. Centrifugal force 240 pushes lid 50, neck 15 and shoulder 12 toward chamber 8 of container 10. During centrifuge operation, centrifugal force 240 can be many times the normal force of gravity, placing a tremendous strain on container 10.

Support bridge 20 is a member positioned between lid 50 and swinging bucket 100 for supporting lid 50, neck 15 and shoulder 12, and preventing centrifugal force 240 from collapsing container 10. The support of neck 15 and shoulder 12 is accomplished through the engagement of lid 50 and neck 15. Thus, the centrifugal force 240 is transferred from lid 50 to swinging bucket 100. To secure its position, support bridge 20 has an aperture into which lid 50 is set, a counter bore defining a lip or flange 22 that engages an edge 52 of lid 50, and a lip 24 that engages an edge 102 of swinging bucket 100.

Figure 5A:
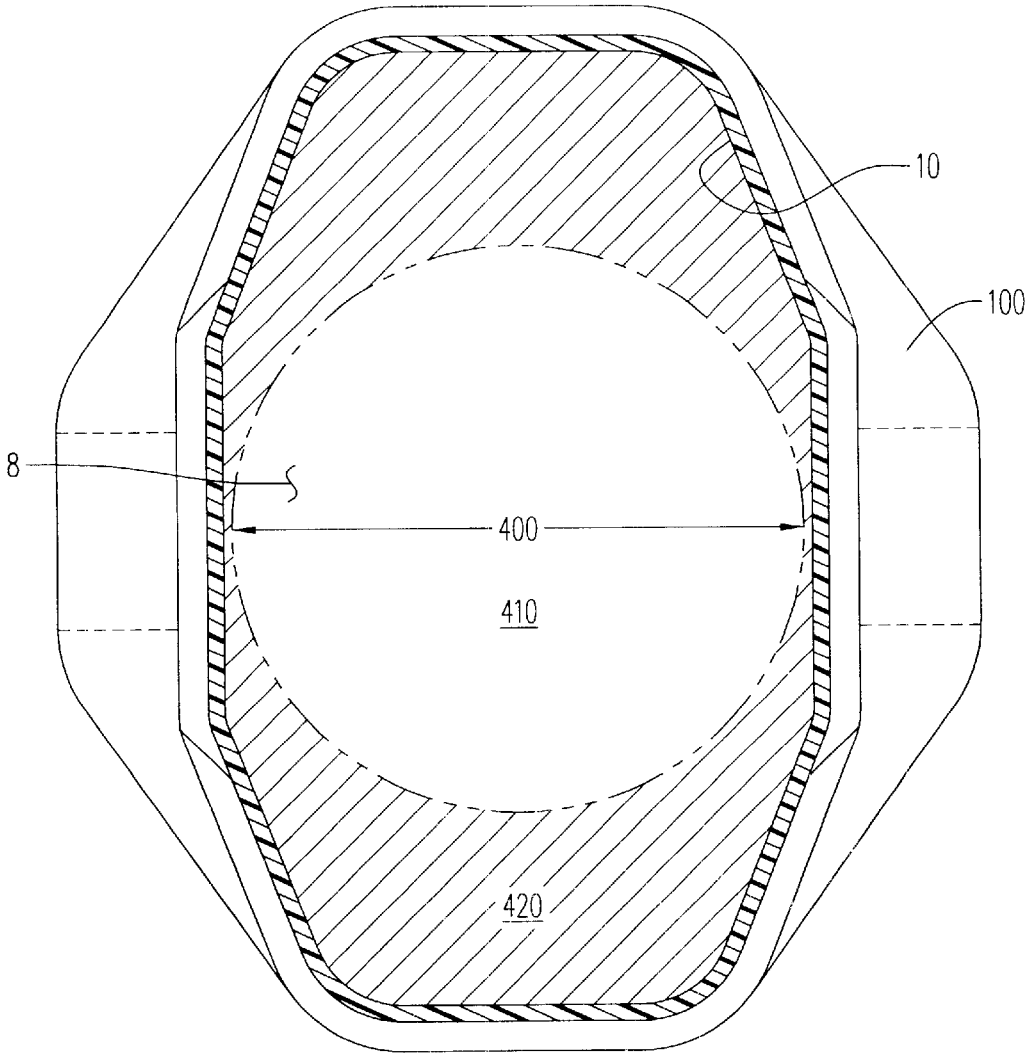
FIG. 5A is a horizontal sectional view taken along line 5A—5A of FIG. 3B.

FIG. 5A is a horizontal sectional view taken along line 5A—5A of FIG. 3B showing the advantage of chamber 8 having a non-cylindrical form. A cylinder held within swinging bucket 100 would be limited to having a diameter 400 and therefore, a footprint represented by the non-shaded area 410. A non-cylindrical footprint can extend further, beyond diameter 400 into the shaded area 420. A cylindrical configuration cannot take advantage of shaded area 420. Accordingly, a non-cylindrical chamber can hold a greater volume than a cylindrical chamber.

Figure 6:
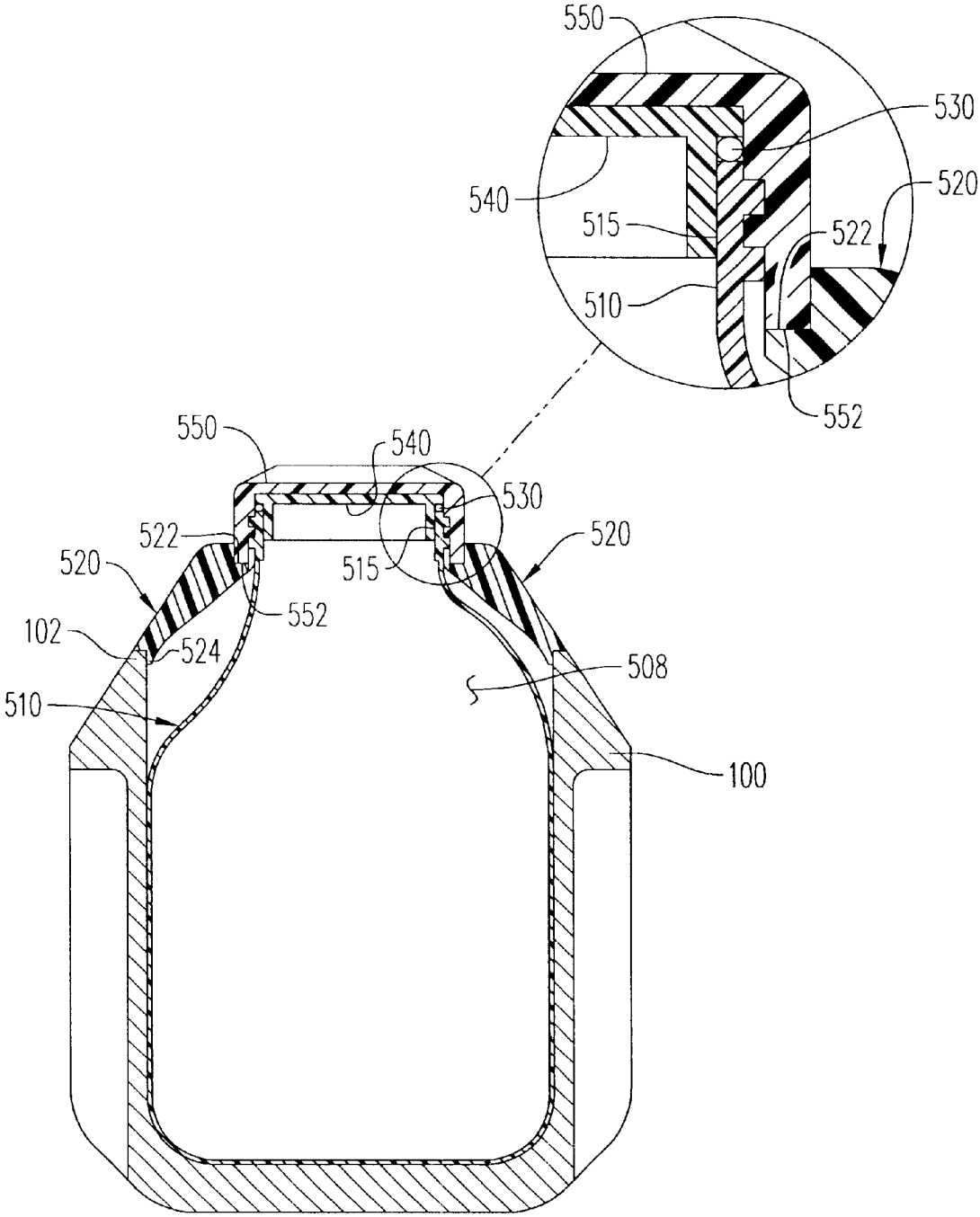
FIG. 6 is a vertical sectional view similar to that of FIG. 3C showing an alternate embodiment of the container assembly of the invention.

FIG. 6 shows a swinging bucket 100 holding another embodiment of a container assembly of the present invention. More particularly, a container 510 is comprised of a bag 508 and a neck 515 with a threaded surface and an opening through which bag 508 can be accessed. Preferably, neck 515 is ultrasonically welded to bag 508. Optionally, an o-ring 530 is positioned on the circumference of insert plug 540, which is inserted into the opening of container 510. Lid 550 has a threaded surface that engages the threads of neck 515.

Lid 550, with the assistance of insert plug 540 and o-ring 530, seals container 510. Neck 515 could have a threaded interior surface and lid 550 could have a threaded exterior surface, or vice versa. However, the threaded surfaces are not essential, and lid 550 can seal container 510 in any suitable manner.

Support bridge 520 is a member positioned between lid 550 and swinging bucket 100 for supporting lid 550 and preventing centrifugal forces from collapsing container 510. Thus, the centrifugal force is transferred from lid 550 to swinging bucket 100. To secure its position, support bridge 520 has an aperture into which lid 550 is set, a counter bore defining a lip or flange 522 that engages an edge 552 of lid 550, and a lip 524 that engages an edge 102 of swinging bucket 100.

Those skilled in the art, having the benefit of the teachings of the present invention may impart numerous modifications thereto. Such modifications are to be construed as lying within the scope of the present invention, as defined by the appended claims.

What is claimed is:

1. A centrifuge system comprising:

a rotor;

a container assembly which comprises a container, a lid on a top of said container, and a member positioned between said lid and an upper portion of said container; and means for holding said container about said rotor, wherein said member abuts a first surface and a second surface of said holding means, wherein said holding means supports said member, and said member supports said lid, and wherein said member transfers a centrifugal force from said lid to said holding mean, and thus prevents said centrifugal force from being transferred to said upper portion of said container.

2. The system according to claim 1, wherein said holding means is a swinging bucket.

3. The system according to claim 1, wherein said member includes a first lip that engages an edge of said lid, and a second lip that engages said surfaces of said holding means.

4. The system according to claim 1, wherein said upper portion of said container includes a shoulder, and said member has a sloping portion substantially conforming to a contour of said shoulder.

5. The system according to claim 1, wherein said member includes an aperture for receiving said lid, and a flange that engages an edge of said lid.

6. The system according to claim 1, wherein said container includes a neck having (a) an aperture for providing access to said container, and (b) a first threaded surface, and wherein said lid includes a second threaded surface that engages said first threaded surface.

7. The system according to claim 1, wherein said container is non-cylindrical.

8. The system according to claim 1, wherein said container comprises a bag, an d a neck having (a) an aperture for providing access to said bag, and (b) a first threaded surface, and wherein said lid includes a second threaded surface that engages said first threaded surface.

9. The system according to claim 8, wherein said container assembly comprises a weld for attaching said neck to said bag.

10. The system according to claim 1, wherein said container is made of a plastic selected from the group consisting of polyethyleneterephthalate, polypropylene, and polycarbonate.

11. A container assembly for use in a bucket of a centrifuge, said bucket having first and second surfaces, said container assembly comprising:

a container having a neck and an upper portion;

a lid for scaling said container; and a member disposed between said lid and said upper portion, and having a contour for abutting said first surface and said second surface of said bucket, wherein said member, when said container assembly is installed in said bucket, supports said lid and transfers a centrifugal force from said lid to said bucket, and thus prevents said centrifugal force from being transferred to said upper portion of said container.

12. The assembly according to claim 11, wherein said member includes a first lip for engaging an edge of said lid, and a second lip for engaging an edge of said bucket.

13. The assembly according to claim 11, wherein said upper portion of said container includes a shoulder, and said member has a sloping portion substantially conforming to a contour of said shoulder.

14. The assembly according to claim 11, wherein said member includes an aperture for receiving said lid, and a flange that engages an edge of said lid.

15. The assembly according to claim 11, wherein said neck includes (a) an aperture for providing access to said container, and (b) a first threaded surface; and wherein said lid includes a second threaded surface that engages said first threaded surface.

16. The assembly according to claim 11, wherein said container is non-cylindrical.

17. The assembly according to claim 11, wherein said container comprises a bag;

wherein said neck includes (a) an aperture for providing access to said bag, and (b) a first threaded surface; and wherein said lid includes a second threaded surface that engages said first threaded surface.

18. The assembly according to claim 17, further comprising a weld for attaching said neck to said bag.

19. The assembly according to claim 11, wherein said container is made of a plastic selected from the group consisting of polyethyleneterephthalate, polypropylene, and polycarbonate.

20. A bridge for supporting a lid on a container that is disposed within a centrifuge rotor, said rotor comprising first and second intersecting surfaces, said bridge comprising:

a first lip for engaging an edge of said lid; and a second lip for engaging an edge of said rotor at the intersection of said first surface and said second surface of said rotor when said container is placed within said rotor, wherein said rotor supports said bridge, and said bridge supports said lid, and wherein said bridge transfers a centrifugal force from said lid to said rotor, and thus prevents said centrifugal force from being transferred to an upper portion of said container.

21. The bridge according to claim 20, further comprising a substantially horizontal portion having an aperture, wherein said first lip is a flange disposed about an end of said aperture.

22. The bridge according to claim 20, further comprising a sloping portion substantially conforming to a contour of a shoulder of said container, wherein said second lip is adjacent to an edge of said sloping portion.

23. The bridge according to claim 20, wherein said bridge is substantially reverse U-shaped.

24. The bridge according to claim 20, wherein said bridge is made of polypropylene.

* * * * *